United States Patent [19]

Perkins

[11] 4,018,284

[45] Apr. 19, 1977

[54] APPARATUS AND METHOD FOR GRAVEL PACKING A WELL

[75] Inventor: Lee E. Perkins, Houma, La.

[73] Assignee: Kajan Specialty Company, Inc., Houma, La.

[22] Filed: Oct. 20, 1975

[21] Appl. No.: 623,993

Related U.S. Application Data

[63] Continuation of Ser. No. 534,131, Dec. 18, 1974, abandoned.

[52] U.S. Cl. ..... 166/278; 166/51; 166/205; 166/315; 166/318; 166/319

[51] Int. Cl.² ..... E21B 43/04; E21B 43/10

[58] Field of Search ..... 166/224 R, 51, 278, 166/276, 205, 315, 158, 157, 237, 143, 144, 181, 224 A

[56] References Cited

UNITED STATES PATENTS

| | | | |
|---|---|---|---|
| 2,224,538 | 12/1940 | Eckel et al. | 166/278 |
| 2,337,429 | 12/1943 | Tomlinson | 166/278 |
| 2,586,015 | 2/1952 | Edwards | 166/224 |
| 2,942,664 | 6/1960 | Burns | 166/51 |
| 3,106,932 | 10/1963 | Chisholm | 166/224 X |
| 3,151,681 | 10/1964 | Cochran | 166/224 |
| 3,228,473 | 1/1966 | Baker | 166/224 |
| 3,606,927 | 9/1971 | True et al. | 166/224 A X |
| 3,674,090 | 7/1972 | Urbanosky | 166/276 |
| 3,713,490 | 1/1973 | Young et al. | 166/205 X |
| 3,789,926 | 2/1974 | Henley et al. | 166/224 R |

*Primary Examiner*—Stephen J. Novosad
*Attorney, Agent, or Firm*—Fleit & Jacobson

[57] ABSTRACT

An apparatus is disclosed for packing the annular space between the exterior of a sand screen or liner and the well casing or bore with accurately sized sand or gravel to prevent the intrusion of well sands into the well casing or bore. The apparatus includes a hydraulically actuated fluid diverting means and release mechanism to open diverting passageways and separate the sand screen or liner assembly from the run-in tool before introduction of the sized sand or gravel and without rotation of the run-in tool with respect to the sand screen or liner. The diverting means is capable of being closed at the completion of the injection process to facilitate the resumption of production from the well without the necessity of pulling the assembly out of the well bore for closing the diverting means thereby providing a novel method for gravel packing or sand packing a well.

40 Claims, 15 Drawing Figures

APPARATUS AND METHOD FOR GRAVEL PACKING A WELL

This is a continuation of U.S. patent application Ser. No. 543,131, filed Dec. 18, 1974 now abandoned.

BACKGROUND OF THE INVENTION

The present invention generally relates to an apparatus for gravel packing or sand packing an annular space in a well such as the space between a sand screen or liner and a well casing or well bore with accurately sized gravel or sand. The gravel or sand is pumped down through a production tubing or drill string and diverted into the annular space by a hydraulically actuated means which diverts the fluid flow externally into the annular space and releases the run-in tool from the liner. The diverting and releasing means can be closed without removing the assembly from the well after injection of the gravel or sand in order to facilitate resumption of fluid production from the well. But, if necessary to remove the run-in tool from the well, this is easily accomplished because of the unique design and operation of the diverting and releasing means.

DESCRIPTION OF THE PRIOR ART

When drilling and completing oil, gas or water wells, many operations and processes are performed in which a fluid or granular material is placed in the annular space between the exterior of a well casing and the wall of a well bore and in many situations, this material is also placed in the annular space between the well casing and a sand screen or liner positioned interiorly of the well casing. In all types of wells, an undesirable condition is sometimes encountered when fine sand is produced along with the production fluid. One well known process for overcoming this problem is known as "gravel packing" or "sand packing" which basically involves positioning a perforated or slotted sand screen or liner in the well bore or casing and packing the annular space between it and the well bore and casing with accurately sized sand or gravel to prevent the intrusion of well sands into this annular space. The sand screen or liner is positioned in the well bore to perform this packing process and the run-in tool must be released to enable the packer and tubing to be withdrawn from the well bore. Release of the run-in tool is necessitated by the fact that the diverting mechanism for directing the sand or gravel flow to the outside of the tubing or drill pipe during the packing operating in prior structures does not have the facility for closing the openings in the diverting mechanism after the packing operation to allow production without first removing the run-in tool.

Further, the operation of disconnecting the run-in tool from the liner or screen in prior art structures requires that the tubing be raised to engage a clutch joint in the assembly and the tubing is then rotated to release the tubing from the sand screen or liner. Frequently, this clutch joint and threaded releasing mechanism fails to release properly because small particles get lodged in the threads because of other complications in the releasing mechanism due to the sand environment. When this occurs, the entire assembly must be recovered to correct the problem which necessitates the re-running of the screen or liner and again performing the gravel or sand packing operation.

U.S. Pat. No. 3,072,204 issued Jan. 8, 1963 discloses one type of such apparatus for gravel packing a well.

SUMMARY OF THE INVENTION

The primary object of the invention resides in the method and apparatus by which the sand screen is released from the run-in tool before the sand or gravel packing operation begins, by which the fluid diverting crossover device is operated and by which the openings in the crossover device can be closed upon completion of the packing operation to allow production to proceed without removal of the run-in tool or equipment.

The primary object of the invention is attained by a structural arrangement in which a hydraulically actuated mechanism causes the release of the run-in tool from the sand screen hook-up nipple. As initially placed down-hole, the run-in tool is connected to the hook-up nipple through several radially movable balls which, in their anchoring position, are partially received in holes in the connected components with a mandrel retaining the balls in their anchoring position. The mandrel is sectional and retained in its initial position by one or more shear pins which are sheared by hydraulic pressure exerted on a plug or dart placed in the upper end of the mandrel. Shearing of the shear pins actuates the mandrel to enable the balls to move into a recess so that the connected components may be separated. In addition, hydraulic actuation of the mandrel will open slots in the fluid diverting crossover component which diverts fluid flow externally into the annular space.

A further object of the invention is provided by the ability of the operator to subsequently close the open slots in the fluid diverting crossover component from outside the well and thereby again reseal the inside of the tubing or drill pipe from the annulus to thereby permit production operations to proceed without withdrawing any equipment from the well.

Another object of the invention is to provide an apparatus which eliminates the previously encountered difficulty in releasing the tubing from the sand screen in present type constructions thus eliminating the additional trip with the tubing in order to place the well into production with the apparatus being dependable in operation and effective for diverting fluid and releasing the run-in tool from the hook-up nipple.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS ILLUSTRATING THE PREFERRED EMBODIMENT

DESCRIPTION OF THE PREFERRED EMBODIMENTS

Figure 1:
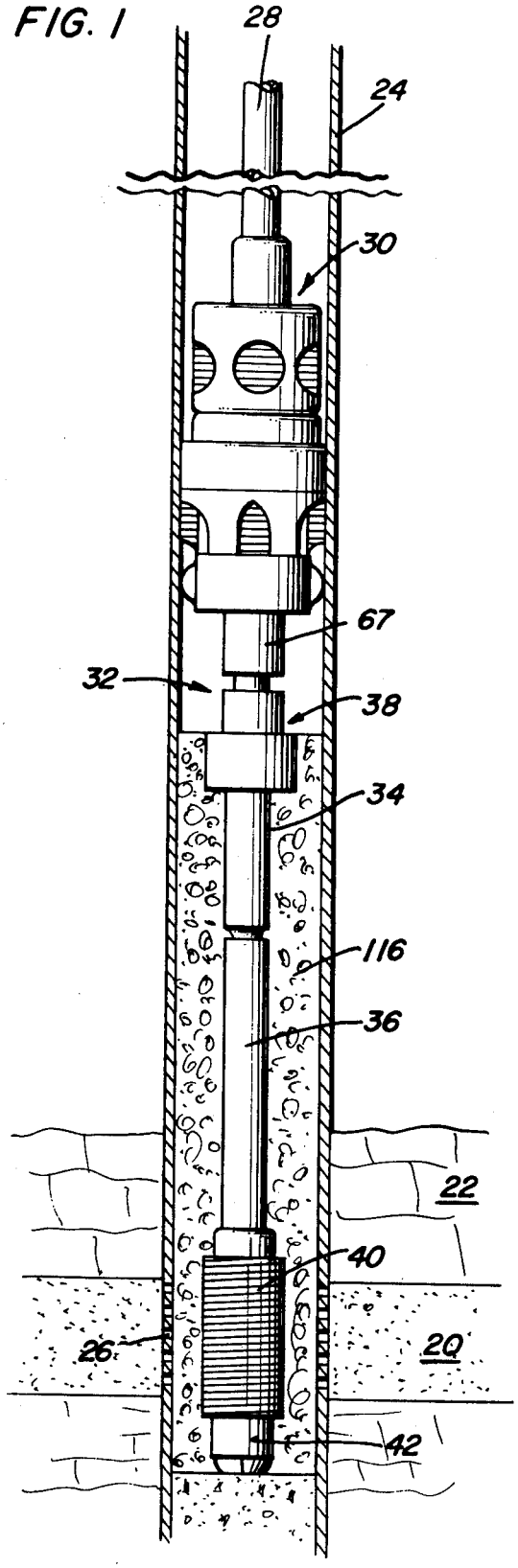
FIG. 1 is a diagrammatic sectional view of a typical well in which the apparatus of the present invention is used for gravel or sand packing.

Referring now specifically to the drawings, FIG. 1 illustrates the present invention installed in a typical well with the portion of the well extending to the surface being omitted but with a production zone 20 of a formation 22 being illustrated along with a well casing 24 having a perforated area 26 in the production zone. In some instances, the casing 24 may terminate above the production zone with it being pointed out that the present invention may be used with various types of wells either with or without a casing with the production tubing or drill pipe 28 being packed off by a conventional packer assembly 30 oriented above the production zone in a conventional and well known manner. Positioned below the packer 30 is a fluid diverting crossover, sand screen or liner releasing mechanism generally designated by reference numeral 32 including a hook-up nipple generally designated by numeral 34 connected to a blank pipe 36 at its lower end and connected with a stinger assembly 38 at its upper end. The blank pipe 36 is connected with a perforated or slotted sand screen or liner 40 which is provided, as shown, with a wash-down shoe 42 at its lower end. In some installations, the blank pipe 36 need not be used in which event the liner 40 would be connected directly to the hook-up nipple 34.

The wash-down shoe 42 is conventional and includes a bottom opening 44 and a coiled compression spring 46 retaining a vertically disposed wash tube 48 in an upper position so that a valve 50 separate from the lower end thereof is maintained in a closed condition except during periods of reverse flow. In some installations it is not necessary or desirable to use the wash tube 48 since its inclusion in the assembly requires withdrawal of the run-in tool in order to remove the wash tube from the well prior to production operations.

Figure 2:
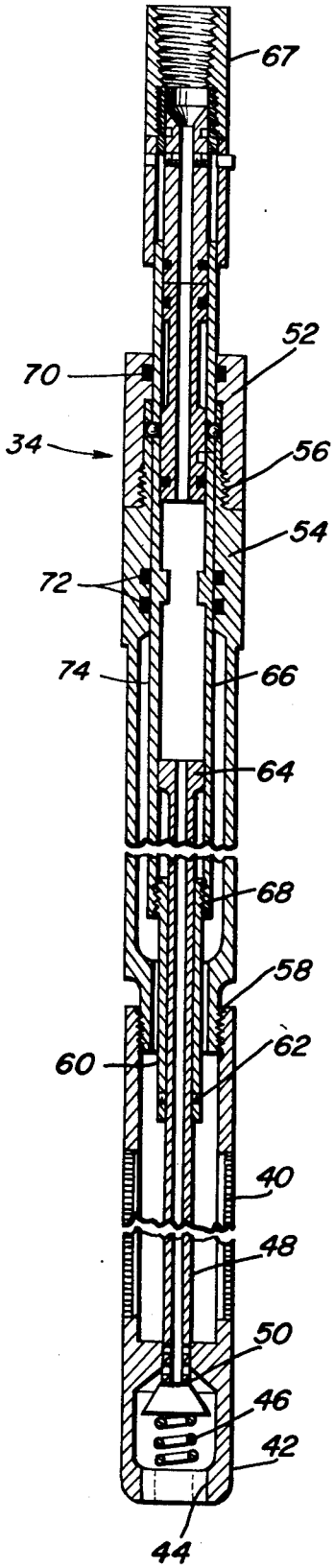
FIG. 2 is a longitudinal, sectional view of the present invention including the sand screen or liner together with a wash tube and wash-down shoe, if desired.
Figure 3:
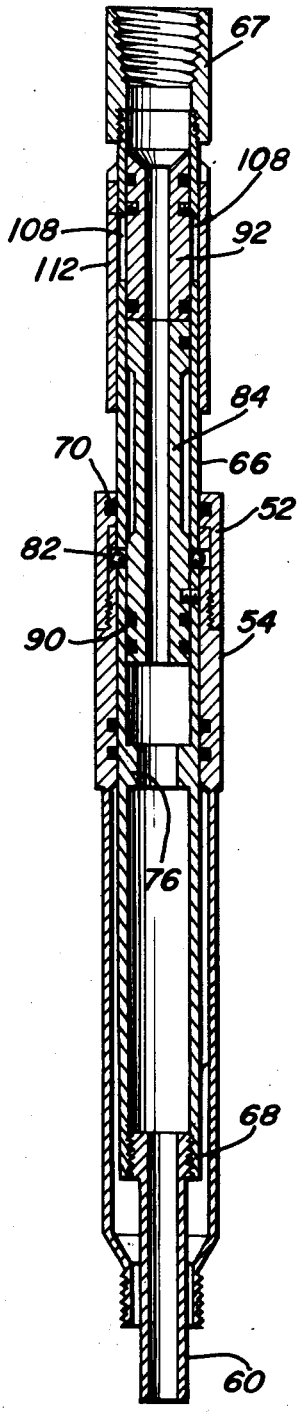
FIG. 3 is a longitudinal, sectional view of the invention including the device for running and releasing the sand screen along with the mechanism for actuating the fluid diverting crossover.

The hook-up nipple 34 includes a threaded adapter 52 having a depending elongated housing 54 threaded thereto at 56. The lower end of the housing 54 is threaded to the pipe 36 or connected directly to the screen or liner 40 if the blank pipe 36 is not used, with this latter arrangement being illustrated in FIG. 2, the threaded connection being designated at 58. The wash tube 48 extends through a wash tube retaining adapter 60 which has setscrews 62 in the lower end thereof for locking the wash tube 48 in the lowermost position thus holding the valve 50 in the open position to permit reverse circulation in order to wash any sand fill from the casing. Recovery of the wash tube is attained by the upset upper end 64 thereof being larger than the adapter 60.

Figure 8:
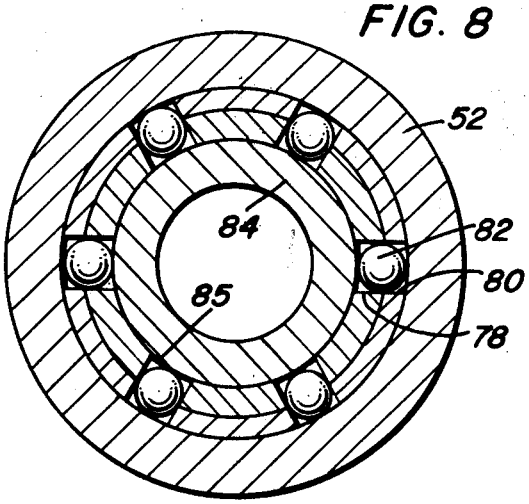
FIG. 8 is a transverse, sectional view taken substantially upon a plane passing along section line 8-8 of FIG. 4 illustrating the relationship of the releasing mechanism when in anchored position.
Figure 9:
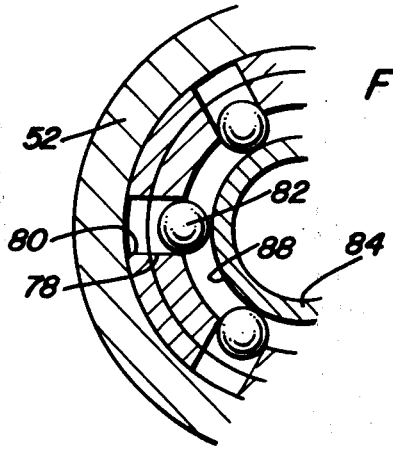
FIG. 9 is a fragmental sectional view taken substantially upon a plane passing along section line 9-9 of FIG. 5 illustrating the releasing mechanism in released position.
Figure 10:
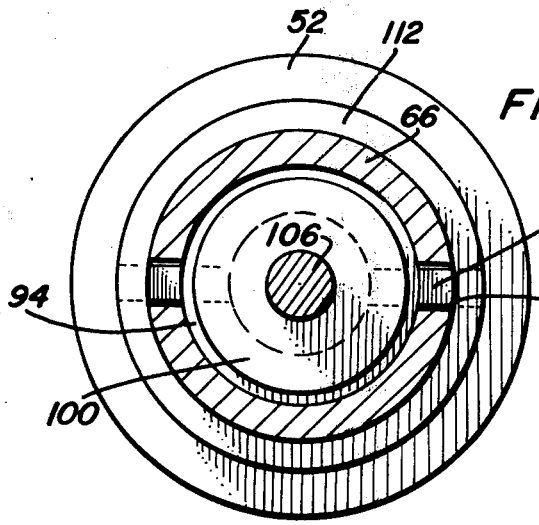
FIG. 10 is a transverse, sectional view taken substantially upon a plane passing along section line 10—10 of FIG. 5 illustrating the crossover slots when in open condition and their association with the dart or tripping plug.
Figure 4:
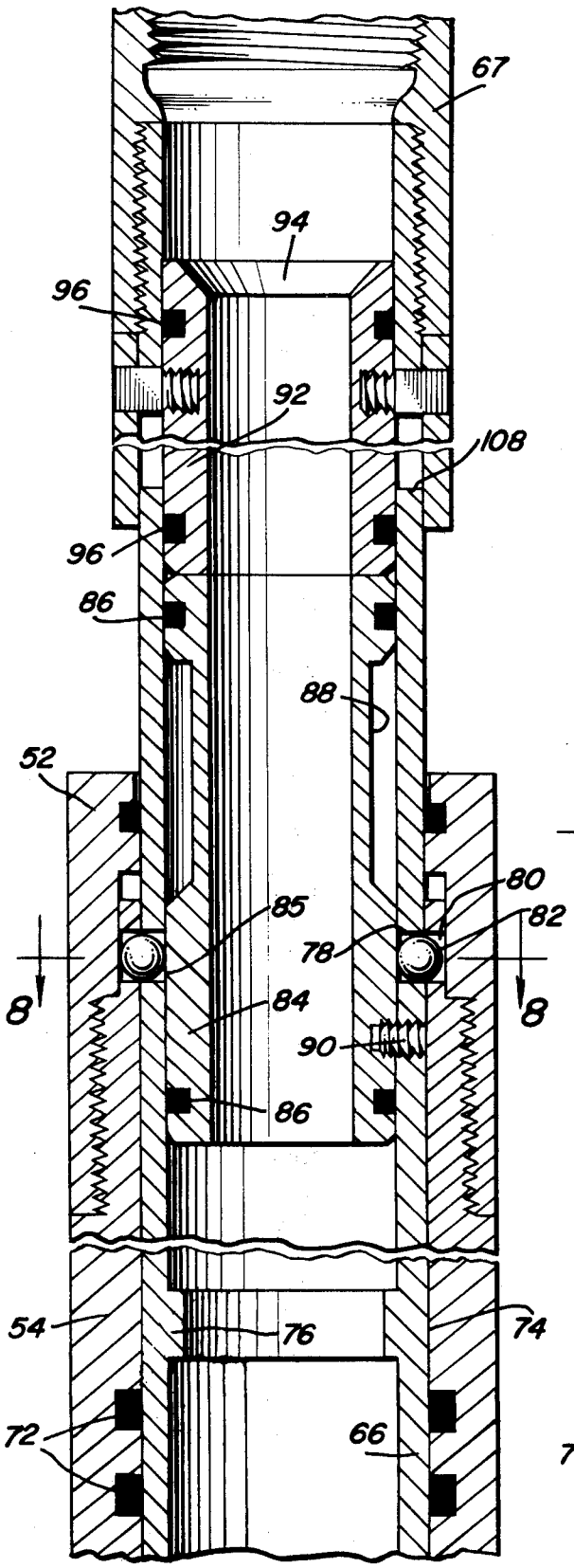
FIG. 4 is a longitudinal, vertical sectional view, on an enlarged scale, illustrating the releasing and fluid diverting crossover mechanism in which the crossover is closed and the releasing mechanism is in anchoring position.

Movably positioned within the hook-up nipple 34 and forming part of the stinger assembly is a tubular mandrel 66 which has its lower end threadedly connected to the wash tube adapter 60 by a threaded connection 68 which will recover the wash tube when the diverting crossover assembly is removed. The mandrel 66 extends up through the housing 54 with the upper end being threadably connected to a connector collar 67 on the lower end of packer assembly 30 or tubing string 28. The threaded adapter 52 has a wiper ring 70 disposed interiorly thereof and housing 54 includes seal rings 72 engaging the external surface 74 of the mandrel 66 which is of substantially constant diameter through its length. Mandrel 66 is also provided with an internal shoulder 76 and a plurality of radial holes 78 above the shoulder 76 (FIG. 4). The holes 78 are in registry with and in alignment with similar holes 80 in the hook-up nipple with the holes 80 being adjacent the upper end of the housing 54. As illustrated in FIG. 4, the holes 78 and 80, when in registry, receive balls 82 which are partially disposed in the holes 78 and partially in holes 80 thus locking the mandrel 66 to the housing 54 and adapter 52 thereby preventing relative movement therebetween and connecting the mandrel 66 to the hook-up nipple 34. As shown in FIG. 8, six balls are spaced equidistant around the circumference of mandrel 66. However, it is contemplated that additional balls may be employed on wider diameter tools, such as eight or ten or more, and that even as few as four balls may be employed on narrower tools.

Longitudinally movably disposed within the interior of the mandrel 66 is an inner lower mandrel 84 having external seal rings 86 adjacent the upper and lower ends thereof. Mandrel 84 has a longitudinally extending, external, reduced diameter portion 88 which has inclined end walls and which will register with the holes 78 when the inner mandrel 84 is moved downwardly to its unlocking position illustrated in FIG. 5. In the unlocking position, balls 82 can move away from and thus out of holes 80 in the upper part of housing 54 and be completely received in holes 78 thus releasing the mandrel 66 from the housing 54 and adapter 52. For releasably securing the inner lower mandrel 84 in its upper or anchoring position with the external surface 85 aligned with holes 78, a threaded shear pin 90 is threaded through the mandrel 66 into the mandrel 84 thus retaining the mandrel 84 in the position of FIG. 4 until a downward force is exerted on the mandrel 84 with respect to the mandrel 66 sufficient to shear pin 90 or multiple similar shear pins 90 if more than one is desired.

Figure 5:
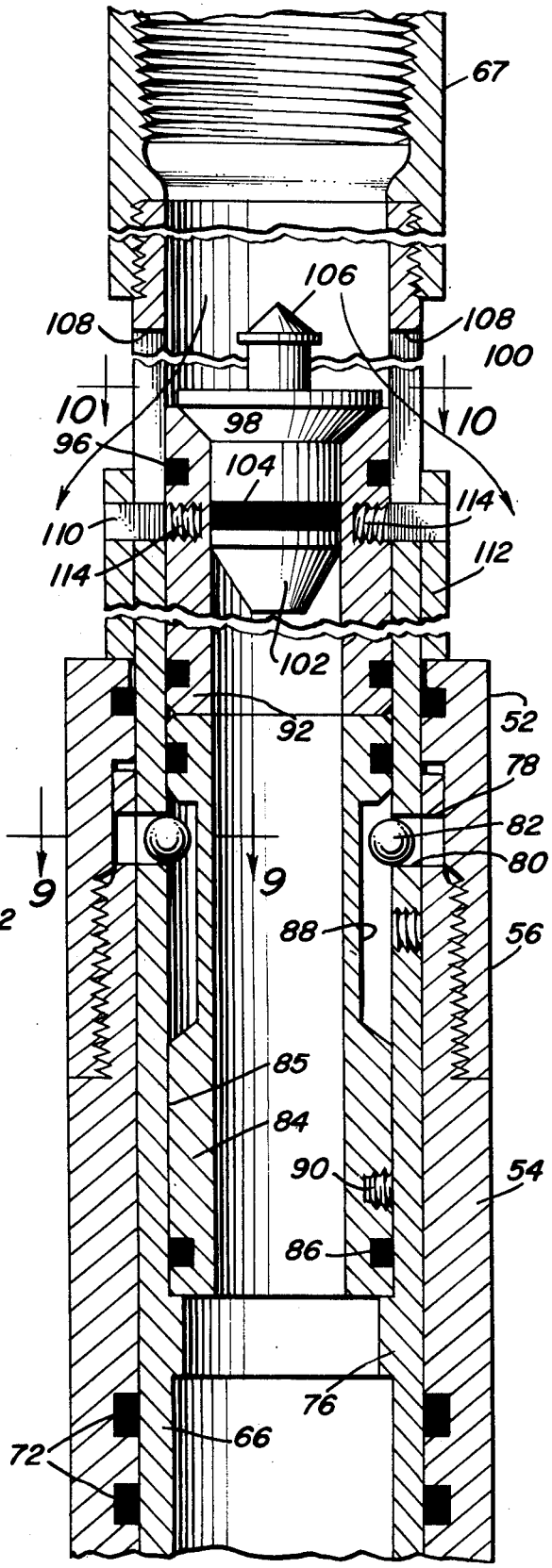
FIG. 5 is a sectional view similar to FIG. 4 but illustrating the fluid diverting crossover in open position and the releasing mechanism in release position.

The structure for moving the inner lower mandrel 84 downwardly includes an upper inner mandrel or sleeve valve 92 having a valve seat 94 formed in the upper end thereof and the bottom end abutting against the lower mandrel 84. Seal rings 96 are provided on the exterior of the upper mandrel 92 for sealing engagement with the inner surface of the mandrel 66 illustrated in FIG. 4. When it is desired to move the lower mandrel 84 downwardly to release the mandrel 66, a tripping dart or plug 98 is positioned in engagement with the valve seat 94 (See FIG. 5). The plug 98 includes an outwardly flared upper end 100 engaging the seat, a tapered lower end 102 and a seal ring 104 for sealing the plug in the interior of the upper mandrel 92. The upper end of the plug 98 is provided with a projection 106 by which the plug 98 may be manipulated. When the plug is in the position illustrated in FIG. 5, hydraulic pressure through the tubing will force the plug and inner mandrels 92 and 84 downwardly to shear pin 90, release mandrel 66 from lower mandrel 84, and force the recessed portion 88 of the mandrel 84 into registry with the holes 78 thus partially receiving the balls therein as illustrated in FIG. 5. Thus, balls 82 will move out of the holes 80 in the mandrel 66 so that the mandrel 66 may move longitudinally in relation to the adapter 52 and housing 54 which supports and is connected to sand screen or liner 40. Accordingly, by this mechanism the sand screen or liner 40 which is supported by nipple 34 is released from the run-in tool or equipment which is connected to and supports mandrel 66 before the sand or gravel packing operation is begun. Hence, removal of the run-in tool is simply and conveniently accomplished without the possibility of malfunction which has plagued prior structures.

To provide discharge of fluid with sand or gravel entrained therein from the tubing, the upper end portion of the mandrel 66 is provided with longitudinally elongated, radial slots or ports 108 which are closed by the upper mandrel 92 when the upper mandrel 92 is in its original upper position, as illustrated in FIG. 4, but opened when the mandrel 92 has moved downwardly to its lower position, as illustrated in FIG. 5. Thus, upper mandrel 92 acts as a sleeve valve for slots 108. The downward movement of the upper mandrel 92 is guided and controlled by pins 110 which extend through the slots 108 and have their outer ends anchored in a sleeve 112 and their inner ends threaded into the exterior of the upper mandrel 92 as indicated by numeral 114. Also, the sleeve 112 covers the slots 108 when mandrel 92 and sleeve 112 are in their upper position, and sleeve 112 serves to limit downward movement of the mandrel 92 which is also limited by the lower end of the mandrel 84 engaging the shoulder 76 as illustrated in FIG. 5.

Figure 6:
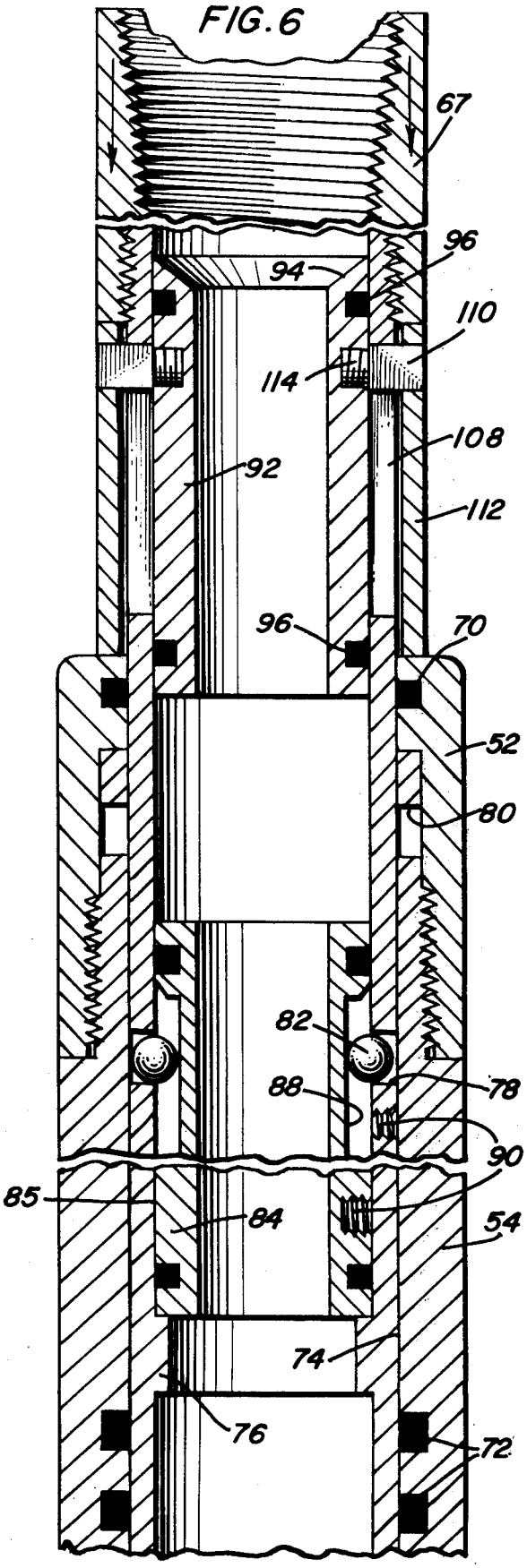
FIG. 6 is a vertical sectional view similar to FIG. 5 but with the fluid diverting crossover having been closed by lowering the tubing string and the dart or tripping plug recovered.

Having sheared pin 90 and moved lower mandrel 84 and upper mandrel 92 to their down positions, slots 108 are then open. Fluid with sand or gravel entrained therein is then fed down the tubing and out through the slots 108 into the annulus between the sand screen and well casing and well bore where it is then forced into the formation, as by passing through the perforated area 26 of casing 24. Once the sand or gravel packing is completed slots 108 are closed by lowering mandrel 66 which thus lowers slots 108 with respect to upper mandrel 92 and sleeve 112 to thereby again block the passages 108 from inside the tubing to the now filled annulus. This reclosed position is shown in FIG. 6. Sleeve 112 also serves to hold mandrel 92 stationary when the tubing string 28 and mandrel 66 are lowered to reclose ports 108.

Figure 7:
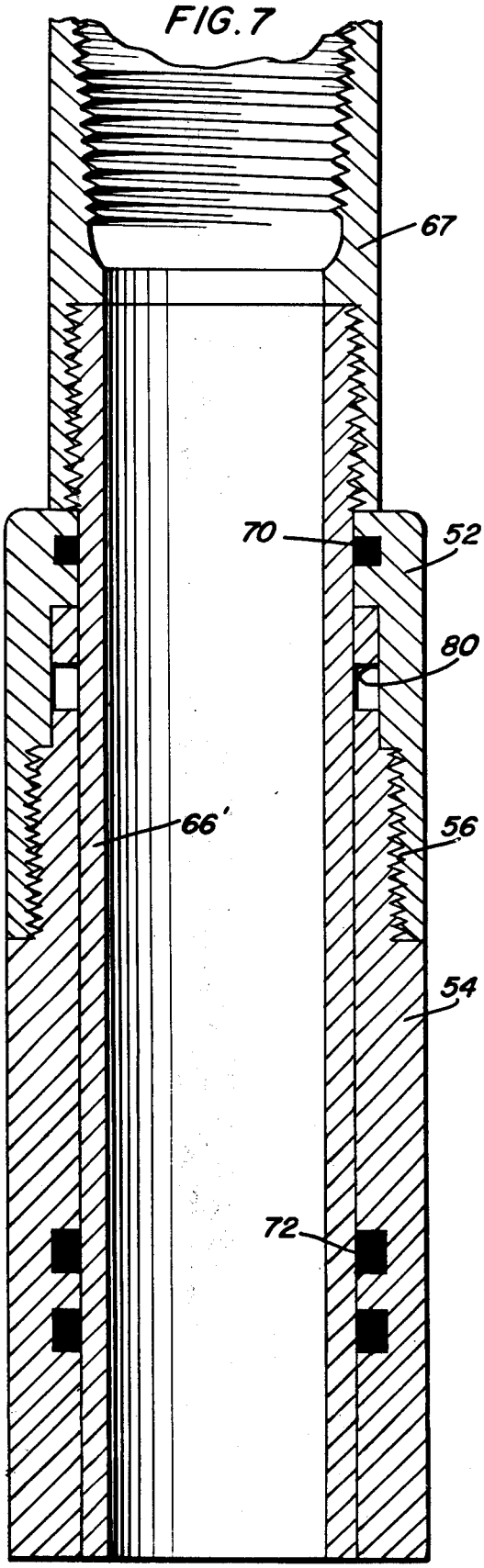
FIG. 7 is a sectional view similar to FIG. 6 but illustrating the run-in device having been recovered and a production stinger placed in the hook-up nipple in preparation for production.

Once mandrel 66 is positioned to reclose slots 108, upper mandrel 92 with seals 96 at its upper and lower ends seals the fluid passage at each end and thereby prevents fluid passing in either direction. The well can then be placed on production through the interior of the sand screen 40 and into the production tubing 28 without further delay if the original equipment of this invention is run into the well without the wash tube 48 as aforedescribed. In the event that the tubing or drill pipe has to be withdrawn from the well in order to remove the wash tube 48 or place gas lift valves or other equipment in the tubing string, FIG. 7 illustrates a stinger or mandrel 66' which would replace the mandrel 66 and which is smooth on the exterior surface thereof and which can be run back into the hook-up nipple for sealing in the hook-up nipple to permit production through the sand screen.

Figure 11:
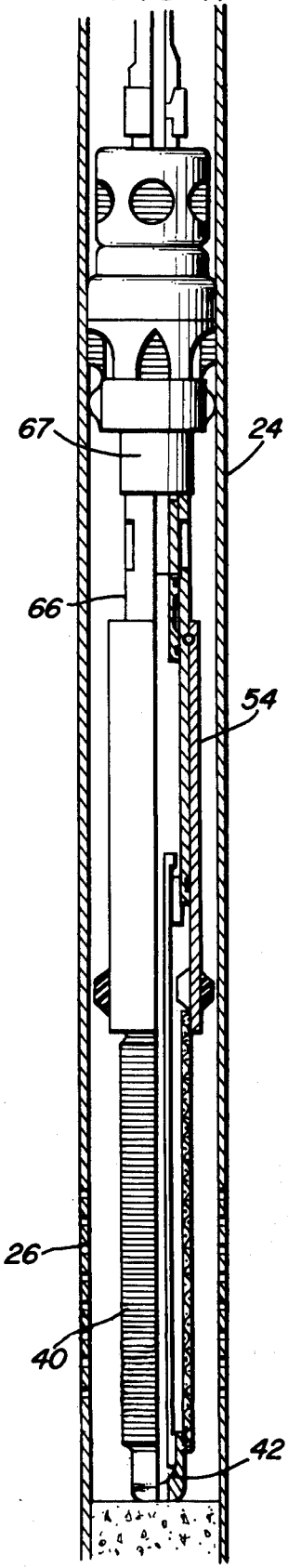
FIG. 11 is a diagrammatic view illustrating the assembly in a well bore in preparation to perform a gravel or sand packing operation.
Figure 12:
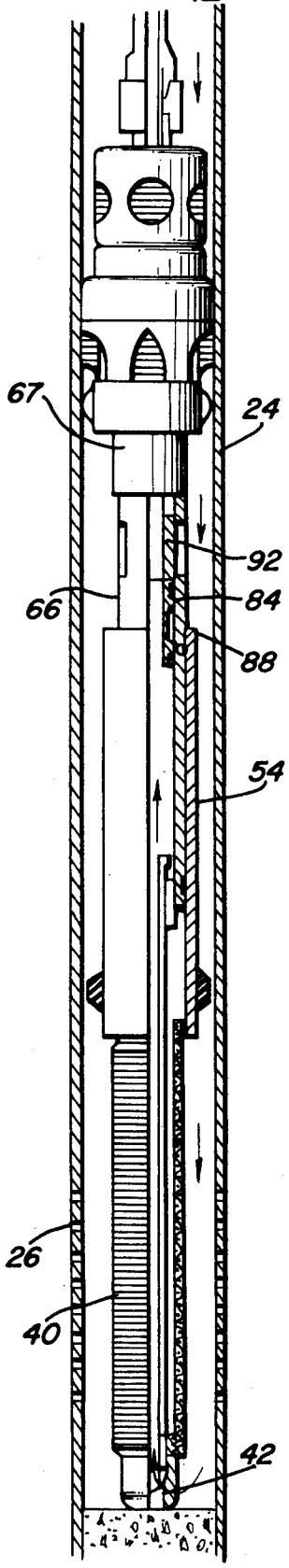
FIG. 12 is a view similar to FIG. 11 illustrating reverse circulation for removal of sand fill in the annular space by the use of the wash tube and wash-down shoe.
Figure 13:
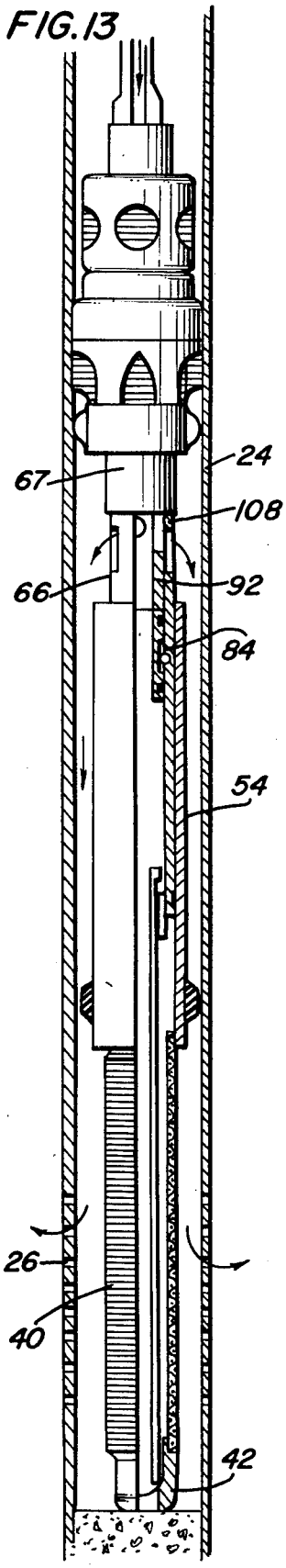
FIG. 13 is a view similar to FIGS. 11 and 12 illustrating the packer in the set position to isolate the area below the packer from the annulus above and the tripping dart in position after activating the fluid diverting crossover and releasing mechanism so that the sand or gravel can be injected into the formation through the annulus between the sand screen and the well casing.
Figure 14:
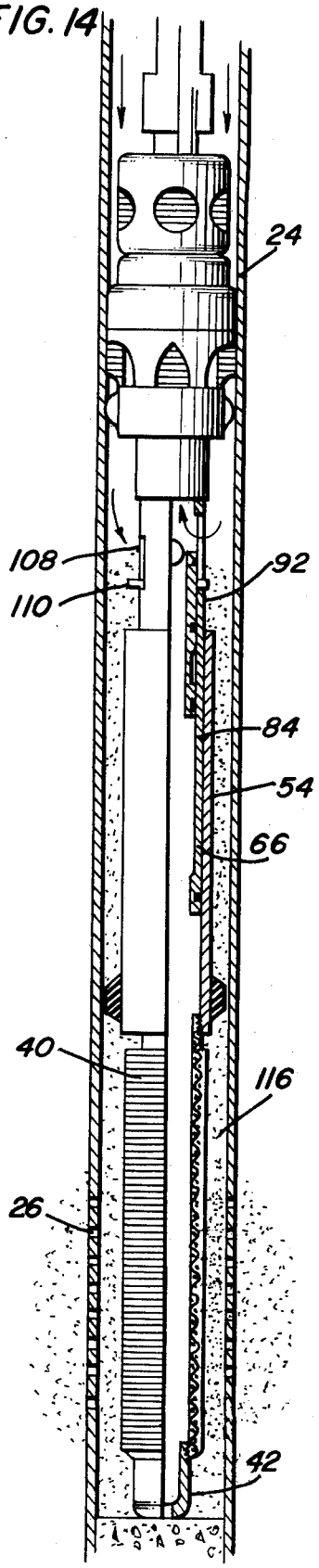
FIG. 14 is a similar diagrammatic view illustrating the gravel or sand pack in the annulus between the sand screen and well casing and into the well formation with the packer in the released or unset position permitting reverse circulation of excess material from the run-in tubing string.
Figure 15:
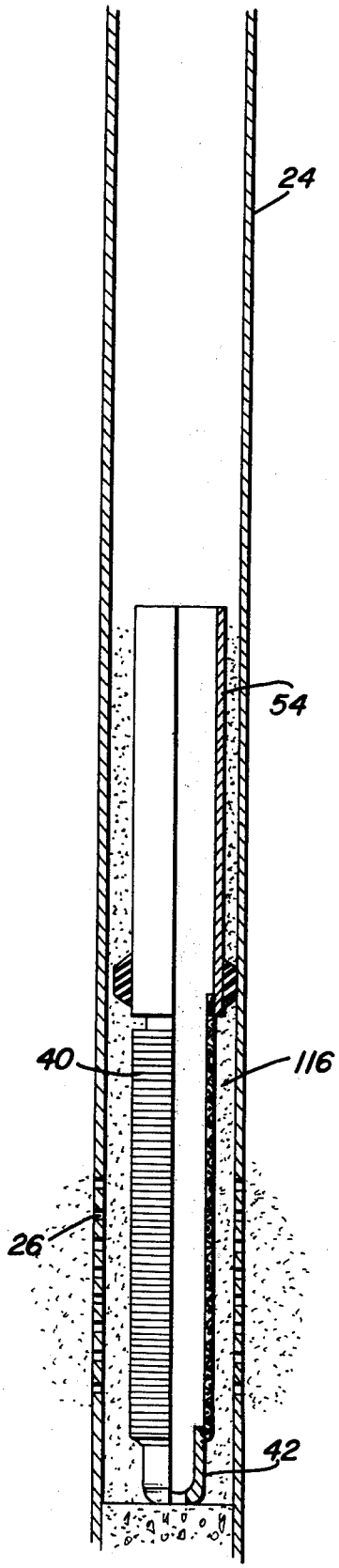
FIG. 15 is a similar view illustrating the run-in assembly removed and the gravel or sand pack in position along with the sand screen.

FIGS. 11 through 15 illustrate schematically the operation of my invention whereby a gravel or sand pack can be achieved and the gravel or sand screen separated from the run-in equipment. FIG. 11 illustrates the apparatus placed in the well bore in preparation for a gravel or sand packing operation and FIG. 12 illustrates the reverse circulation, that is, down around the periphery of the packer and apparatus and in through the wash-down shoe as indicated by the arrows so that any fill sand that may have accumulated in the well bore will be removed. It will be appreciated by those skilled in the art that this step and the associated wash tube can be omitted under appropriate circumstances. FIG. 13 illustrates the assembly in the position for injecting the gravel or sand 116 into the annulus with the packer in the set position to isolate the area below the packer from the annulus above. As illustrated, the tripping dart is in position and the fluid diverting crossover has been activated to open position and the releasing mechanism is in the release position. In this condition, the sand screen assembly is free from attachment with the mandrel and the dart or tripping plug is in the seat of the mandrel thereby diverting the fluid being pumped down the tubing to the exterior of the sand screen assembly so that the gravel or sand material will be injected into the formation through the annulus between the sand screen assembly and the well casing as indicated by the arrows in FIG. 13. FIG. 14 illustrates the sand or gravel pack 116 having been accomplished and the packer unseated or released thereby permitting reverse circulation of excess material from the run-in tubing string as indicated by the arrows so that reverse circulation may occur down past the packer and in through the slots thereby removing any excess material that may be in the tubing above the tripping dart or plug. FIG. 15 illustrates the sand or gravel pack in position along with the sand screen or liner with the run-in assembly removed. This assembly enables the well to be placed back on production by connection with appropriate tubing whereby fluid entering the liner from the production zone will be filtered by passing through the sand or gravel pack.

As used herein, the terms "sand or gravel pack", "gravel packing", and "sand packing" contemplate the use of accurately sized sand or gravel or any other type of graded material that is used to bridge or retain formation sand in an oil or gas well or the like.

The foregoing describes the preferred embodiment and is intended only to be illustrative of the principles of my invention. Since those skilled in the art will readily appreciate numerous variations and modifications of the illustrated embodiment without departing from the spirit and scope of my invention, it is not intended that the foregoing be a limitation of my rights except as provided in the appended claims.

What is claimed is:

1. An apparatus for releasably connecting a sand screen assembly to a tubing or pipe depending into a well comprising a tubular housing connected with the sand screen assembly, a tubular mendrel connected with the tubing or pipe and telescopically associated with the tubular housing, said housing and mandrel having aligned sockets in concentric adjacent surfaces, a locking member partially received in each of a pair of aligned sockets when in locking position to prevent relative movement between the housing and mandrel, and movable retaining means for retaining the locking member in locking position, said retaining means including a recess misaligned with the locking member when in locking position and aligned with the locking member when in a release position to enable the locking member to move completely out of one of the aligned pair of sockets thereby enabling separation of the mandrel and housing by relative longitudinal movement.

2. The structure as defined in claim 1 wherein said locking member is in the form of a spherical ball, said mandrel being disposed interiorly of the housing with the socket in the mandrel being in the form of a radial hole, said retaining means including a slidable tubular member disposed internally of the mandrel with the recess being in the form of a longitudinal recess in the exterior surface thereof for alignment with the hole in the mandrel and receiving the locking ball partially therein when aligned with the hole in the mandrel thereby enabling the ball to move out of the socket in the housing whereby the mandrel may be moved longitudinally out of the housing.

3. The structure as defined in claim 2 wherein said slidable tubular member disposed interiorly of the mandrel includes an upwardly facing seat, a plug positionable on the seat for closing the upper end of the tubular member whereby fluid pressure exerted on the plug through the tubing or pipe will move the plug and tubular member downwardly in relation to the mandrel for aligning the recess in the tubular member with the hole in the mandrel.

4. The structure as defined in claim 3 wherein said slidable tubular member is constructed of a lower component and an upper component in engagement with each other but capable of separate and independent longitudinal movement, said mandrel including radial ports therein normally closed by the upper component of the slidable tubular member when in its uppermost position, downward movement of the upper component of the tubular member opening the ports above the plug in the upper end of the tubular member thereby diverting fluid through the ports when the tubular member is moved downwardly thereby simultaneously releasing the tubular housing from the mandrel and enabling diverted flow of fluid through the ports between the interior and exterior of the mandrel.

5. The structure as defined in claim 4 together with radially extending pin means connected with the upper component of the tubular member, said ports being in the form of longitudinal slots, said pins being received in the slots whereby the upper component of the slidable member and the plug inserted thereon may be recovered with the mandrel.

6. The structure as defined in claim 5 together with a rupturable means interconnecting the mandrel and slidable tubular member to retain the tubular member in locking position and with the slots in the mandrel closed with the rupturable means determining the pressure necessary to be exerted on the plug for moving the slidable tubular member to its lowermost position.

7. The structure as defined in claim 6 wherein said rupturable means includes at least one shear pin extending radially between the mandrel and housing.

8. The structure as defined in claim 7 wherein said pin means extending through the slots in the mandrel are rigid with the tubular member, a sleeve concentric with the mandrel and covering the slots when in an upper position, said sleeve being secured to said pin means for movement with the tubular members.

9. The structure as defined in claim 2 wherein said mandrel includes radial ports in the upper portion thereof, said ports being normally closed by the tubular members, downward movement of the tubular member opening said ports and enabling circulation of fluid between the interior and exterior of the mandrel to enable sand or gravel to be pumped out through the ports into a producing zone of a formation.

10. The structure as defined in claim 9 wherein said slidable tubular member disposed interiorly of the mandrel includes an upwardly facing seat, a plug positionable on the seat for closing the upper end of the tubular member whereby fluid pressure exerted on the plug through the tubing or pipe will move the plug and tubular member downwardly in relation to the mandrel for aligning the recess in the tubular member with the hole in the mandrel.

11. A fluid diverting assembly for wells comprising a tubular mandrel connected with a tubing string and disposed within a well bore, said mandrel including radially disposed port means adjacent the upper end thereof, a tubular sleeve valve slidably disposed in said mandrel and forming a closure for the port means when in an upper position and opening the port means when in a lower position, plug means axially engageable with the upper end portion of the sleeve valve to form a closure therefor whereby hydraulic pressure may be exerted on the sleeve valve to move it downwardly to open the port means, and means rigid with the sleeve valve and extending into the port means to interconnect the mandrel and valve to enable recovery of the valve with the mandrel, said port means being in the form of longitudinal slots in the mandrel, said rigid means being in the form of pins on the valve extending into the slots.

12. The structure as defined in claim 11 together with a sleeve externally slidably mounted on the mandrel for covering and revealing said slots, said pins extending through said slots and rigidly connected with the sleeve for moving the sleeve with the sleeve valve thereby enabling passage of fluid axially through the mandrel and sleeve valve when the sleeve valve is in its upper, slot closing position and enabling passage of fluid radially through the slots when the sleeve valve and plug means are in their lower, slot opening position.

13. The structure as defined in claim 11 wherein said mandrel has its lower end telescoped into a hook-up nipple, said hook-up nipple including a tubular housing adjacent its upper end and connected with a perforated liner at its lower end, and means releasably retaining the mandrel within the interior of the housing.

14. The structure as defined in claim 13 wherein said retaining means includes a locking ball partially received in a radial hole in the mandrel and partially received in a socket in the housing when in position to lock the mandrel within the housing, said sleeve valve retaining the ball in locking position when in its slot closing position and including recess means receiving said ball to enable movement of the ball out of the socket in the housing for releasing the mandrel from the housing when the sleeve valve is moved to slot opening position.

15. The structure as defined in claim 14 wherein said sleeve valve and mandrel are interconnected by rupturable shear pin means releasably retaining the sleeve valve in slot closing and ball locking position until a predetermined force is exerted on the valve and plug means.

16. A method for releasing a sand screen assembly from a tubing or pipe depending in a well bore which comprises telescopically aligning at least one hole in a tubular mandrel connected to said tubing or pipe between a socket in a tubular housing having the sand screen assembly depending therefrom and a retaining surface of a movable tubular member so as to receive a locking means in said hole and socket and hydraulically forcing said retaining surface to move relative to said hole to allow said locking means to move out of said socket and thereby permit free telescope movement between said tubular mandrel and said tubular housing.

17. A method for packing a well with a granular material, the method comprising the steps of: detachably connecting a sand screen or liner means with a run-in tool; introducing the run-in tool, with its associated sand screen or liner means, into said well; positioning the sand screen or liner means in the well location wherein packing is to be effected; releasing the sand screen or liner means from the run-in tool; introducing and packing the granular material around said screen or liner means through an opening in the run-in tool; and closing said opening whereby the well can be placed on production without withdrawal of said run-in tool from the well.

18. A method for packing a well with a granular material, the method comprising the steps of: detachably associating a sand screen or liner means with a run-in tool; introducing the run-in tool, with its associated sand screen or liner means, into said well; positioning the sand screen or liner means in the well location wherein packing is to be effected; releasing the sand screen or liner means from the run-in tool; and subsequently introducing the granular material to said well, wherein said sand screen or liner means is released from the run-in tool by inducing relative motion between a first and a second mandrel for releasing a releasable connection between the sand screen or liner means and the run-in tool.

19. The method recited in claim 18, wherein said granular material is introduced through said run-in tool.

20. The method recited in claim 18, wherein said sand screen or liner means is hydraulically released from said run-in tool.

21. The method recited in claim 18 and further comprising the step of producing the well with the sand screen or liner means positioned in the well.

22. An apparatus for packing a well with a granular material, the apparatus comprising: sand screen or liner means for retaining sand granular material in said well; run-in tool means for introducing said sand screen or liner means to said well; release means for detachably connecting said sand screen or liner means to said run-in tool means; control means for actuating said release means and for releasing said sand screen or liner means from said run-in tool means at a desired location in said well; delivery opening means for introducing said granular material to said well after actuation of said release means by said control means; and means to close said delivery opening means without withdrawal of said run-in tool means from said well.

23. An apparatus for packing a well with a granular material, the apparatus comprising: sand screen or liner means for delivering said granular material to said well; run-in tool means for introducing said sand screen or liner means to said well; release means for detachably connecting said sand screen or liner means with said run-in tool means; control means for actuating said release means and for releasing said sand screen or liner means from said run-in tool means; and delivery means for introducing said granular material to said well, subsequent to the actuation of said release means by said control means, wherein said release means includes a first mandrel and a second mandrel moveable relative to one another and positioned between said sand screen or liner means and said run-in tool means.

24. The apparatus recited in claim 23, wherein said granular material is introduced through said run-in tool means.

25. The apparatus recited in claim 23, wherein said release means is hydraulically actuated.

26. The apparatus recited in claim 23, and further comprising at least one shear pin for maintaining the relative orientation between said first and second mandrels until actuation of said release means.

27. The apparatus recited in claim 23, and further comprising first connector means for fixing said first mandrel to said run-in tool means; second connector means fixed to said sand screen or liner means; moveable coupling means for locking said first connector means to said second connector means when in a first position and releasing said first connector means from said second connector means when in a second position; and wherein said second mandrel maintains said moveable coupling means in its first position until actuated by said control means.

28. The apparatus recited in claim 27, wherein said moveable coupling means comprises at least one ball; wherein said first and second connector means each comprises a ball seat for associating with said ball when said moveable coupling means is in its first position; and wherein said second mandrel comprises a ball seat for freeing said ball from its seat in one of said first or second connector means upon said release means being actuated by said control means.

29. An apparatus for releasing a sand screen assembly in a well and packing a granular material in the annulus exterior of the screen assembly which comprises:

a tubular housing with a sand screen assembly connected thereto;

a tubular mandrel adapted to connect to the lower end of a tubular member suspended in the well and telescopically received within said tubular housing;

a cross-over passage in said tubular mandrel connecting the interior of said tubular member with the annulus;

a retaining means interconnecting said tubular mandrel and said tubular housing for retaining said housing and mandrel in a preset position and a valve means closing said cross-over passage when said housing and mandrel are in said preset position; and control means to simultaneously release said retaining means thereby allowing said tubular housing to be released and move said valve means to open said cross-over passage for introduction of the granular material into said annulus.

30. An apparatus in accordance with claim 29 wherein said control means is hydraulically actuated.

31. An apparatus in accordance with claim 29 wherein said retaining means includes a moveable coupling means which locks said tubular housing to said tubular mandrel when in a first position and releases said tubular housing from said tubular mandrel when in a second position.

32. An apparatus in accordance with claim 31, and further comprising a tubular sleeve means telescopically received within said tubular mandrel which maintains said moveable coupling means in its first position until actuated by longitudinal movement relative to said tubular mandrel.

33. An apparatus in accordance with claim 32 wherein said moveable coupling means comprises at least one ball, said tubular housing and said tubular mandrel each including a ball seat for association with said ball when said moveable coupling means is in its first position, and said tubular sleeve means including a ball seat for freeing said ball from its seat in the tubular housing.

34. An apparatus in accordance with claim 29, and further including means for closing said cross-over passage after introduction of the granular material into said annulus whereby production of the well can commence without removal of said tubular mandrel from said well.

35. An apparatus in accordance with claim 29 wherein said retaining means includes one or more locking members partially received in each of a pair of aligned sockets when in locking position to prevent relative movement between the tubular housing and the tubular mandrel, and moveable tubular means for retaining the locking member in locking position, said tubular means telescopically received within said tubular mandrel and including a recess misaligned with a locking member when in locked position and aligned with a locking member when in released position to enable the locking member to move completely out of one of the aligned pair of sockets thereby enabling separation of the mandrel and housing by relative longitudinal movement.

36. The structure as defined in claim 35 wherein said locking member is in the form of a spherical ball, said mandrel being disposed interiorly of the housing with the socket in the mandrel being in the form of a radial hole, the recess in said tubular means being in the form of a longitudinal recess in the exterior surface thereof for alignment with the hole in the mandrel and receiving the locking ball partially therein when aligned with the hole in the mandrel thereby enabling the ball to move out of the socket in the housing whereby the mandrel may be moved longitudinally out of the housing.

37. An apparatus in accordance with claim 29, wherein said cross-over passage comprises radially disposed port means adjacent the upper end of said tubular mandrel and said valve means comprises a tubular sleeve means slidably disposed within said mandrel and forming a closure for the port means when in an upper position and opening the port means when in a lower position.

38. An apparatus in accordance with claim 37, and further including a plug means axially engageable with the upper end portion of said tubular sleeve means to form a closure therefor whereby hydraulic pressure may be exerted on the sleeve means to move it downwardly to open the port means, and means rigid with the sleeve means and extending into the port means to interconnect the mandrel and sleeve means to enable recovery of the sleeve means with the mandrel.

39. An apparatus in accordance with claim 29 wherein said retaining means and said valve means include a pair of cooperating slidable sleeve means telescopically received within said tubular mandrel and said control means includes a plug means positioned on the upper of said slidable sleeve means to seal off said tubular mandrel whereby hydraulic pressure created in said tubular mandrel will force said pair of sleeve means downwardly to release the retaining means and open the cross-over passage.

40. An apparatus in accordance with claim 39, and further including one or more shear pins interconnecting said tubular mandrel and the lower of said pair of slidable sleeve means whereby said slidable tubular means are initially retained in their upper position.

* * * * *